United States Patent [19]

Sugawara et al.

[11] Patent Number: 4,911,125

[45] Date of Patent: Mar. 27, 1990

[54] METHOD AND APPARATUS FOR CONTROLLING THROTTLE VALVE IN INTERNAL COMBUSTION ENGINE

[75] Inventors: Hayato Sugawara, Katsuta; Shigeru Horikoshi, Mito; Kenji Ohta, Katsuta, all of Japan

[73] Assignees: Hitachi, Ltd., Tokyo; Hitachi Automotive Engineering Co., Ltd., Katsuta, both of Japan

[21] Appl. No.: 331,386

[22] Filed: Mar. 31, 1989

[30] Foreign Application Priority Data

Apr. 1, 1988 [JP] Japan ..... 63-78197

[51] Int. Cl.[4] ..... F02D 9/08

[52] U.S. Cl. ..... 123/399; 123/361

[58] Field of Search ..... 123/361, 399

[56] References Cited

U.S. PATENT DOCUMENTS

| | | | |
|---|---|---|---|
| 4,353,339 | 10/1982 | Collonia | 123/399 X |
| 4,508,078 | 4/1985 | Takeuchi et al. | 123/399 |
| 4,601,271 | 7/1986 | Ejiri et al. | 123/399 X |
| 4,781,162 | 11/1988 | Ishikawa et al. | 123/399 |
| 4,809,659 | 3/1989 | Tamaki et al. | 123/399 |

FOREIGN PATENT DOCUMENTS

| | | | |
|---|---|---|---|
| 3146652 | 6/1983 | Fed. Rep. of Germany | 123/399 |
| 0129432 | 6/1986 | Japan . | |

*Primary Examiner*—Willis R. Wolfe

*Attorney, Agent, or Firm*—Fay, Sharpe, Beall, Fagan, Minnich & McKee

[57] ABSTRACT

Disclosed is a method and apparatus for controlling a throttle valve driven by a D.C. motor in an internal combustion engine, in which the D.C. motor is driven until a valve position sensor detecting the angular position of the throttle valve generates an output signal which coincides with the output signal of an accelerator pedal sensor detecting the amount of depression of an accelerator pedal of a vehicle. The value of motor current required for causing very slight displacement of a return spring provided for returning the throttle valve toward a predetermined angular position is utilized for automatically compensating various factors of fluctuation attributable to friction, inertia, etc. of means driving the throttle valve. A small-capacity microprocessor is used to control the D.C. motor so that the throttle valve can operate with high accuracy and high-speed response capability without being adversely affected by changes in the operating condition as well as secular variations.

6 Claims, 9 Drawing Sheets

METHOD AND APPARATUS FOR CONTROLLING THROTTLE VALVE IN INTERNAL COMBUSTION ENGINE

BACKGROUND OF THE INVENTION

This invention relates to a method and apparatus for controlling a throttle valve in an internal combustion engine so that the throttle valve driven by an electric motor can be opened and closed through an angle corresponding to the amount of depression of an accelerator pedal in a vehicle.

Control of open-close movement of a throttle valve in an internal combustion engine by means of an electric motor is already known from, for example, the disclosure of JP-A-61-129432 (1986).

According to the disclosure of the cited publication, a stepping motor is used to drive the throttle valve. Although the use of such a stepping motor for automatically controlling the open-close movement of the throttle valve is preferable in that the angular position of rotation of the throttle valve can be controlled with high accuracy, there is an inevitable tendency that the operation of the throttle valve is insufficient in its high-speed response capability.

A D.C. motor is preferably used in lieu of the stepping motor so as to ensure the desired high-speed response capability of the throttle valve. However, attainment of the desired high-speed response capability of the throttle valve driven by the D.C. motor tends to be affected by the factors of fluctuation which include: (a) changes in the coefficient of friction of the rotor shaft of the motor; (b) non-uniform spring constants of springs of throttle valves due to non-uniformity of the characteristics of manufactured products; and (c) secular variations (so-called permanent set) of the spring constant.

In order to solve problems as described above, an automatic control apparatus of highly advanced character adapted for self-tuning is required, resulting in an increase in the cost of its control circuit.

Also, an attempt to carry out automatic control by the use of a relatively inexpensive microprocessor will rather reduce the desired high-speed response capability of the throttle valve due to an inherent delay of arithmetic and logical processing.

SUMMARY OF THE INVENTION

With a view to solve the prior art problems pointed out above, it is an object of the present invention to provide a method and apparatus for controlling a throttle valve in an internal combustion engine, in which:

(i) a D.C. motor is used to ensure the desired high-speed response capability of the throttle valve;

(ii) the throttle valve can be controlled with high accuracy without being adversely affected by changes in its operating condition as well as secular variations; and (iii) a relatively inexpensive microprocessor can be sufficiently satisfactorily used for the control.

The above object of the present invention can be attained by always studying the factors of fluctuation affecting the operational characteristic of the D.C. motor.

Briefly describing, the spring constant in a stably stopped state (a full closed state or a full opened state) of the throttle valve is detected for the purpose of the study described above.

Besides the spring constant, there are other factors of fluctuation which are, for example, changes in the frictional force at the bearings of the throttle shaft or motor shaft. However, because a change in the frictional force at the bearings acts to change the apparent value of the spring constant, it is preferable to study the apparent spring constant including the effects of friction, inertia, etc., so that various factors of fluctuation can be highly approximately compensated.

The present invention provides the following advantages:

(i) The use of a D.C. motor in a throttle valve drive mechanism improves the high-speed response capability of the throttle valve.

(ii) Throttle valve control with high accuracy can be achieved because the factors causing fluctuation of the motor characteristic due to changes in the operating condition can be automatically compensated.

(iii) The desired high-speed response capability of the throttle valve can be ensured even by the use of a small-capacity microprocessor, because the factors causing fluctuation of the motor characteristic due to changes in the operating condition can be automatically compensated.

DESCRIPTION OF THE PREFERRED EMBODIMENTS

Preferred embodiments of the present invention will now be described in detail with reference to the drawings.

Figure 2:
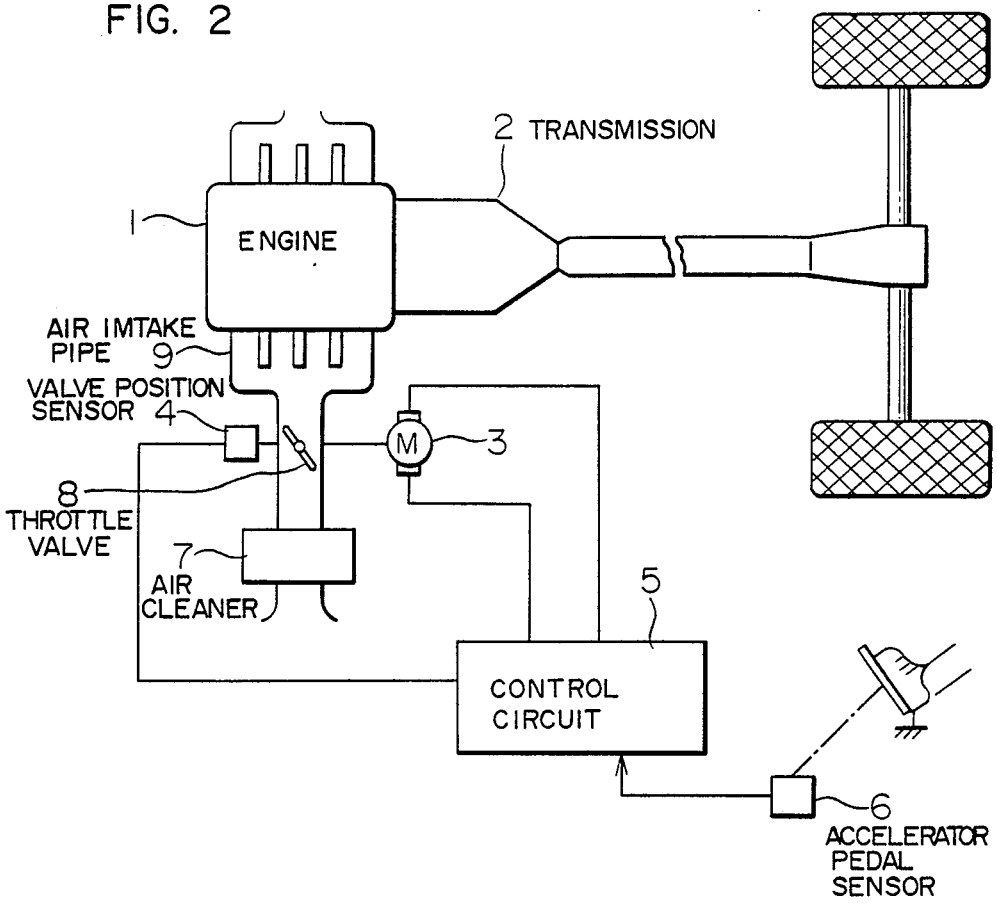
FIG. 2 shows schematically the structure and arrangement of components of a controlled system.

FIG. 2 shows schematically an internal combustion engine 1 provided with an embodiment of the throttle valve control apparatus according to the present invention and shows also a drive system of a vehicle on which the engine 1 is mounted.

Referring to FIG. 2, the output power of the engine 1 is transmitted to wheels through a transmission 2. An air cleaner 7 is mounted at the inlet of an air intake pipe 9 of the engine 1, and butterfly type throttle valve 8 is disposed in the air intake pipe 9.

The throttle valve 8 is driven for open-close movement by a D.C. motor 3 as described later with reference to FIG. 3. The opening of the throttle valve 8 is detected by a valve position sensor (an angular position of rotation sensor) 4 whose detection output signal is applied to a control circuit 5. The control circuit 5 controls current supplied to the motor 3 so that the output signal of the valve position sensor 4 coincides with an output signal of an accelerator pedal sensor 6 which detects the amount of depression of an accelerator pedal. That is, the output signal of the accelerator pedal sensor 6 is used as a target value, and the control circuit 5 controls the current supplied to the motor 3 so that the output signal of the valve position sensor 4 can follow up the target value.

Figure 3:
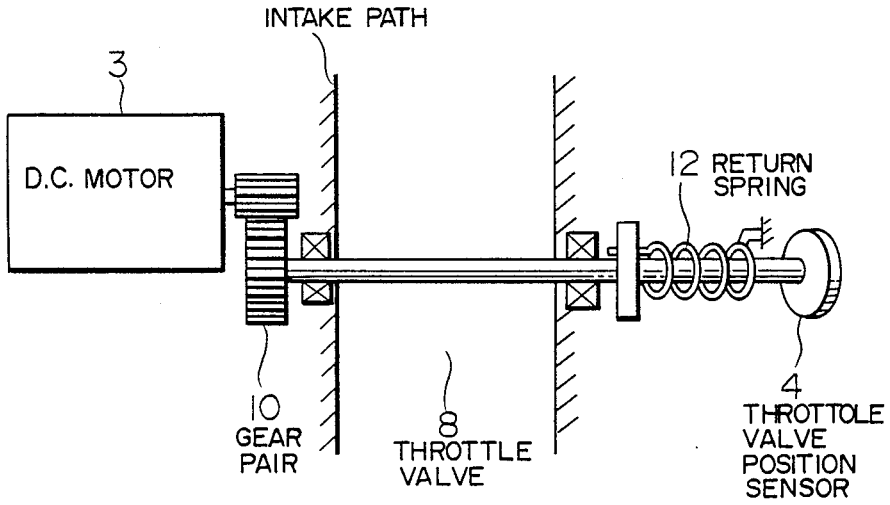
FIG. 3 shows schematically the relation between the throttle valve shown in FIG. 2 and a return spring imparted with an initial load for normally biasing the throttle valve in one direction.

FIG. 3 shows schematically the relation between the D.C. motor 3, the throttle valve 8 disposed in a venturi V of the air intake pipe 9, and the valve position sensor 4.

Referring to FIG. 3, a return spring 12 is imparted with an initial load so as to normally urge the butterfly type throttle valve 8 in a direction in which the throttle valve 8 is full closed. The throttle valve 8 is placed in its most stable state when the movement of the throttle valve 8 urged by the force of the return spring 12 is stopped by being engaged by a stopper (not shown).

The D.C. motor 3 rotates the throttle valve 8 through a gear pair 10 against the biasing force of the return spring 12.

Various parameters are now defined as follows:

$T_m$: Torque produced by motor
$T_{fm}$: Frictional torque of motor shaft
$I_m$: Inertia of motor
$\theta_m$: Rotation angle of motor
G: Gear ratio
$I_g$: Inertia of gear pair
$\theta$: Position of throttle valve
$\theta_o$: Valve position set by return spring (initial load imparted to return spring)
$K_s$: Spring constant
$T_f$: Frictional torque of throttle valve shaft
$T_v$: Air resistance of throttle valve
I: Motor drive current
$K_m$: Current/torque proportional constant of motor Inertia $I_s$ of the throttle valve 8 when current is supplied to the D.C. motor 3 to open the throttle vale 8 from its full closed position is given by $$I_s = I_m G^2 + I_g \tag{1}$$

$$\theta + \frac{K_s}{I_s}\theta - \frac{G}{I}K_m I + \frac{1}{I}(T_f - T_v + T_{fm}\cdot G) = 0$$

Then, $\theta$ and $\theta$ in the equation (1) are substituted by $x_1=\theta$ and $x_2=\theta$ respectively to obtain equations of state which are expressed as follows:

$$\begin{bmatrix} x_1 \\ x_2 \end{bmatrix} = \begin{bmatrix} 0 & 1 \\ -\frac{K_s}{I_s} & 0 \end{bmatrix}\begin{bmatrix} x_1 \\ x_2 \end{bmatrix} + \begin{bmatrix} 0 \\ 1 \end{bmatrix} u \tag{2}$$

$$y = [1\ 0]\begin{bmatrix} x_1 \\ x_1 \end{bmatrix} \tag{3}$$

It is supposed that U and y in the equations (2) and (3) are given by $U=\theta_t$, and $y=x_1$ respectively.

Figure 1:
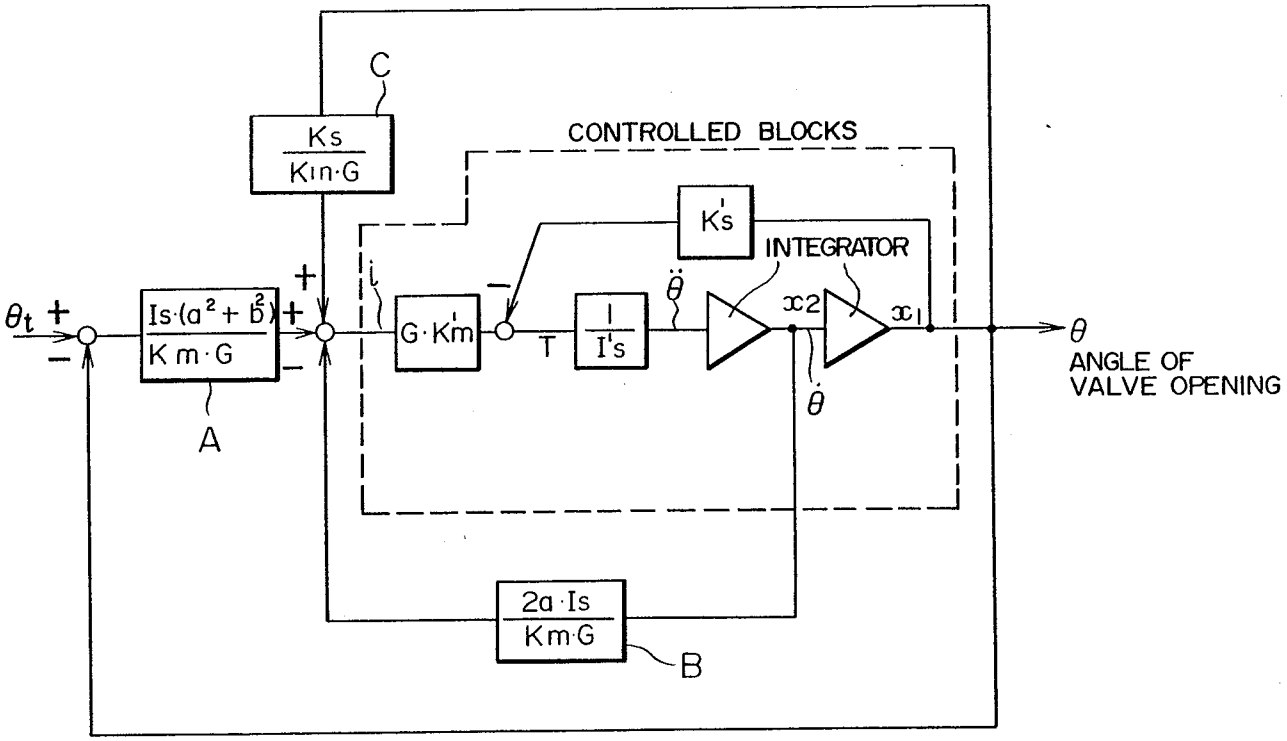
FIG. 1 is a block circuit diagram showing the structure of an embodiment of the present invention in terms of a transfer function.

When, in order to provide a desired response capability, feedback of state given by $$F = \left(2a,\ a^2 + b^2 - \frac{K_s}{I_s}\right)\begin{pmatrix} x_1 \\ x_2 \end{pmatrix}$$

is made, the control system is represented by a block diagram as shown in FIG. 1.

In the block diagram shown in FIG. 1, the controlled blocks are surrounded by broken lines, and a balance of forced imparted to the throttle valve 8 is taken into consideration. The remaining blocks of the system are processed in the control circuit 5 shown in FIG. 2.

The dashed symbol $K_m'$ in FIG. 1 represents the actual current/torque constant of the D.C. motor 3 and differs from the motor current/torque constant $K_m$ used as one of the parameters in the arithmetic and logical processing in the control circuit 5 shown in FIG. 2.

Similarly, the symbols $K_s'$ and $I_s'$ in FIG. 1 represent the actual spring constant and actual inertia respectively. However, the discussion herein will proceed while assuming that $K_s=K_s'$ and $I_s=I_s'$.

When it is additionally assumed that $K_m=K_m'$, the entire control system can be handled by simplified equations of state (4) and (5) as follows:

$$\begin{bmatrix} x_1 \\ x_2 \end{bmatrix} = \begin{bmatrix} 0 & 1 \\ -a^2 - b^2 & -2a \end{bmatrix}\begin{bmatrix} x_1 \\ x_2 \end{bmatrix} + \begin{bmatrix} 0 \\ 1 \end{bmatrix} u \tag{4}$$

$$y = [1\ 0]\begin{bmatrix} x_1 \\ x_1 \end{bmatrix} \tag{5}$$

Consideration of the equations (4) and (5) described above teaches that, when the parameters a and b are suitably set, the response capability of the control system can be made to coincide with a transfer function $G_{(s)}$ given by the following equation (6):

$$G_{(s)} = \frac{a^2 + b^2}{S^2 + 2_{as} + a^2 + b^2} \tag{6}$$

It is to be noted that, because of the limitation in the value of the current that can be supplied to the D.C. motor 3, employment of the state equations (4), (5) and the transfer function given by the equation (6) is difficult when supply of a large current to the D.C. motor 3 is required as a result of calculation. However, the presence of slight non-coincidence will not greatly adversely affect the characteristic (the stability) of the entire control system.

Figure 4:
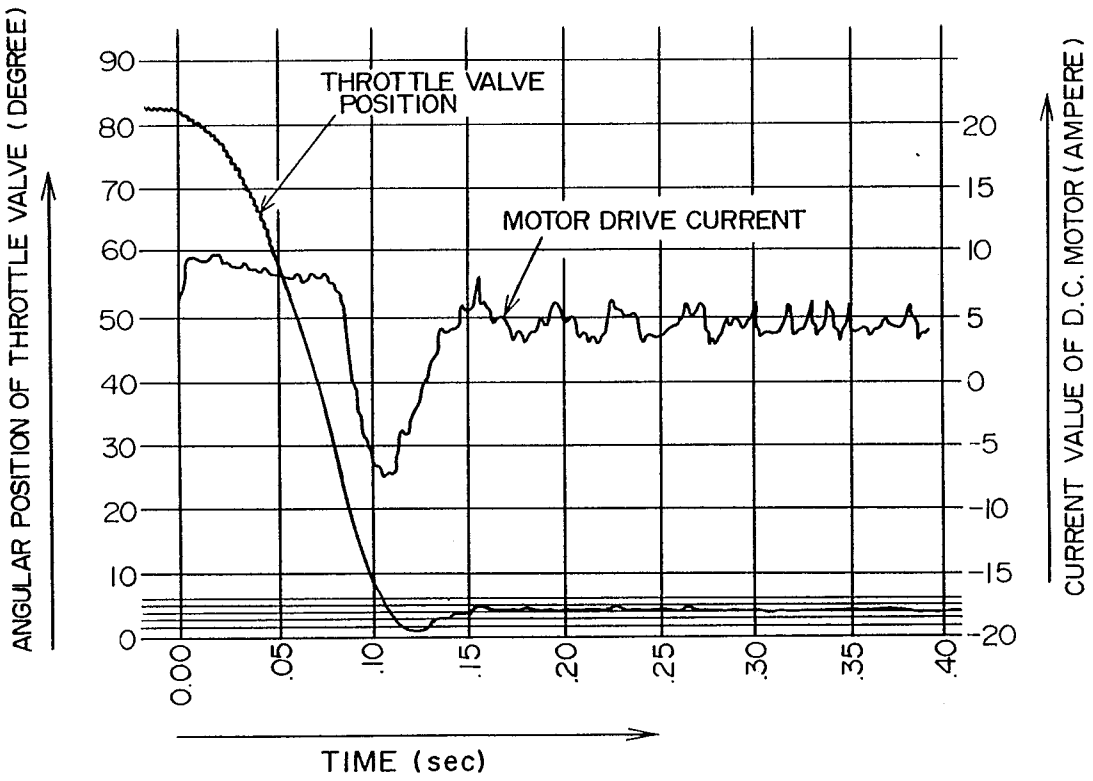
FIG. 4 is a graph showing the control characteristics of the embodiment shown in FIG. 1.

FIG. 4 is a graph in which the horizontal axis represents time, and the vertical axis represents both the actual angular position of rotation of the throttle valve 8 and the actual current value supplied to the D.C. motor 3.

In the embodiment of the present invention, the maximum value of the current that can be supplied to the D.C. motor 3 is restricted so that an excessively large current may not be supplied at the moment of starting the current supply to the D.C. motor 3. The response capability of the control system coincides with the transfer function given by the equation (6) after a period of time of about 0.08 sec on the time axis, because the above restriction is released from that time.

In the application of such a manner of motor rotational position control to the control of the angular position of the throttle valve 8, it is important that an overshoot should not appear in the response of the throttle valve 8, because the movable range of the throttle valve 8 between its full closed position and its full opened position is limited. That is, if the throttle valve 8 collides against the stopper as a result of an overshoot, trouble such as inability of proper operation, generation of noise or shortening of the useful service life is given rise to. In the illustrated embodiment, an overshoot-free response capability can be ensured by suitably selecting the values of the parameters a and b described above.

Figure 5:
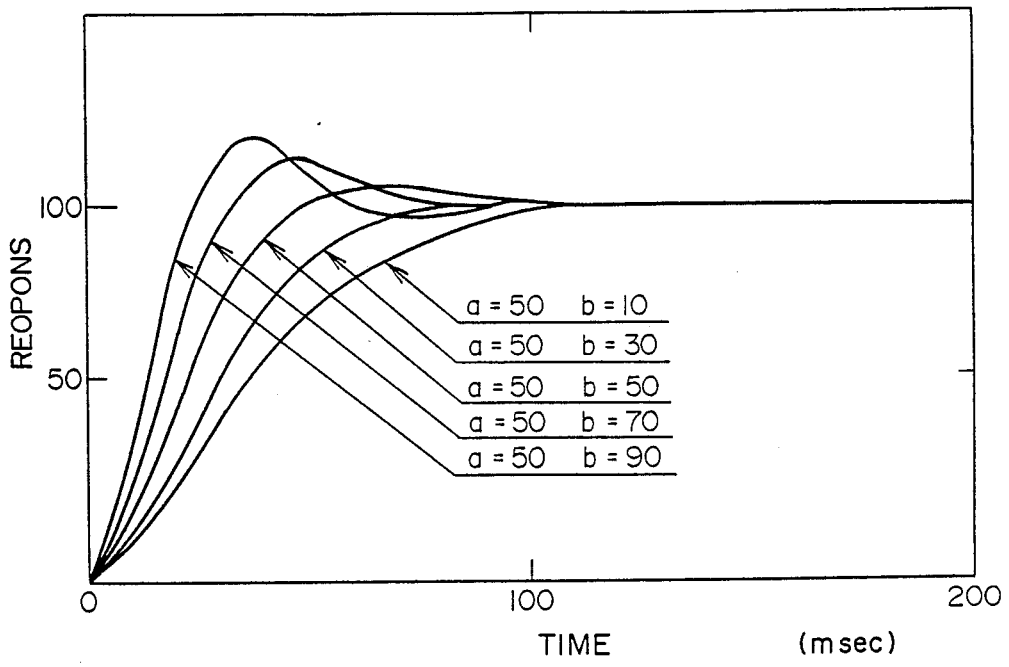
FIG. 5 is a graph showing the response characteristic when a parameter b is changed while maintaining another parameter a constant.

FIG. 5 is a graph showing the response characteristic of the throttle valve 8 when the value of the parameter b is changed while maintaining the parameter a at a fixed value of 50. It will be seen in FIG. 5 that the parameter b has a value with which the possibility of appearance of an overshoot can be eliminated, and the stabilizing period can be decreased to a minimum.

Figure 6:
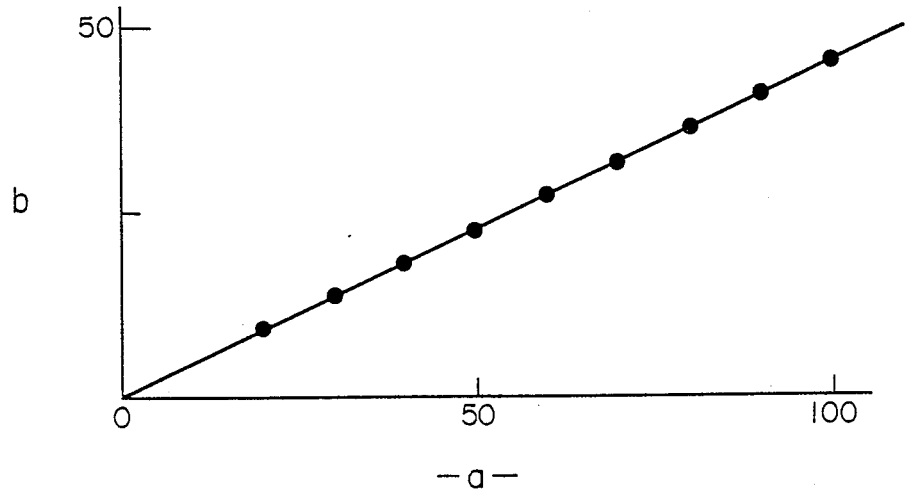
FIG. 6 is a graph showing the optimum values of the parameter a relative to the parameter b.

FIG. 6 is a graph in which the optimum value of the parameter b relative to a value of the parameter a and the optimum value of the parameter a relative to a value of the parameter b are plotted. It is preferable to determine the value of these parameters a and b on the basis of the graph shown in FIG. 6.

In the above discussion, the three elements in the equation (1) are not taken into account. Actually, however, the frictional torque, the hysteresis of the return spring 12 and the initial load setting of the return spring 12 are additional factors to be taken into account.

Figure 7:
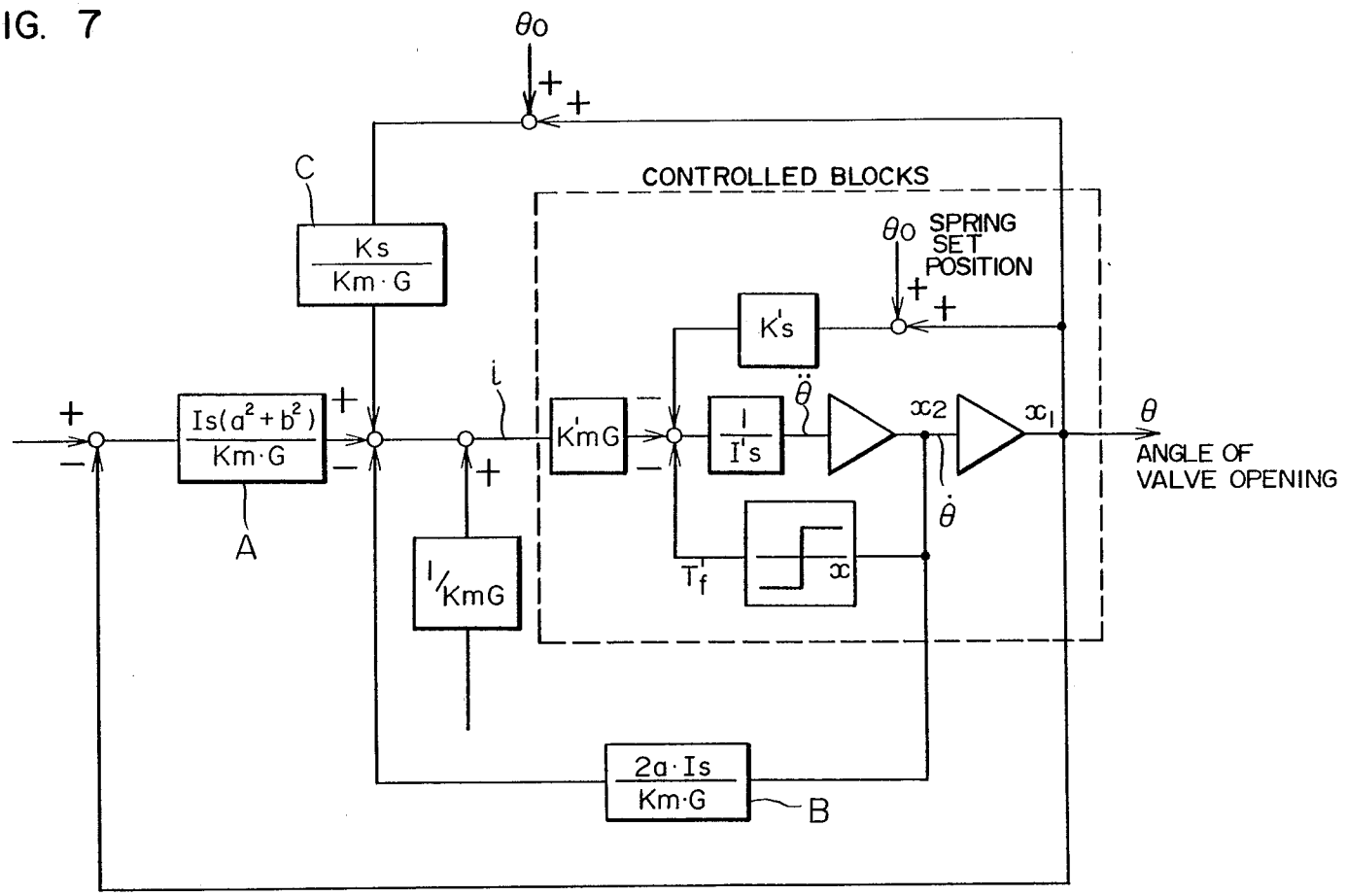
FIG. 7 is a block circuit diagram showing the structure of another embodiment of the present invention in terms of a transfer function.

FIG. 7 is a block diagram corresponding to FIG. 1, and, in the block diagram shown in FIG. 7, the combination of the frictional torque and the hysteresis of the return spring 12 is represented by a symbol $T_f'$ which is a function of $\theta$, that is, a function of the speed, and the initial position of the throttle valve 8 set by the return spring 12 is represented by a symbol $\theta_o'$.

In the block diagram of another embodiment shown in FIG. 7, the initial load setting $K_s' \times \theta_o'$ of the return spring 12 is compensated in the form of $$\frac{K_m'}{K_m} K_s \theta_o$$

in the control apparatus. Also, the parameter $T_f'$ representing the combination of the frictional torque and the hysteresis of the return spring 12 is compensated in the form of $$\frac{K_m'}{K_m} T_f$$

in the control apparatus. Thus, the block diagram shown in FIG. 7 can be handled in a manner similar to the manner of handling the block diagram shown in FIG. 1.

However, in actual operating conditions, the values of the parameters $T_f'$ and $\theta_o'$ show non-negligible changes due to fluctuations of the characteristics of products, changes in the environmental conditions and secular variations. Therefore, the values of the parameters $\theta_o$ and $T_f$ cannot be definitely determined in the control circuit 5.

When the value of $\theta_o'$ cannot be compensated by the value of the parameter $\theta_o$ in the control circuit 5, the following equation holds when the control system is in a stable state, that is, when the throttle valve 8 is in its full opened or full closed position:

$$I_s(a^2+b^2)(\theta_t-\theta)=K_s(G_o-\theta_o')$$

It is assumed that $K_s=K_s'$ and $K_m=K_m'$.

Expansion of the above equation provides the following equation:

$$\theta_t - \theta = \frac{K_s}{I_S(a^2 + b^2)} (\theta_o - \theta_o')$$

This equation represents a deviation or error.

The parameter $T_f'$ is the function of the differentiated value $\theta$. That is, the value of $T_f'$ changes with the speed. When the throttle valve 8 starts to move in one direction, a force tending to obstruct the movement of the throttle valve 8 in the direction is produced to provide a frictional load by $(T_f'-T_f)$. In this case, the value of $(T_f'-T_f)$ is preferably $T_f'-T_f=0$ from the aspect of the operational characteristic of the throttle valve 8. However, attainment of the relation $T_f'-T_f=0$ is very difficult and impractical.

The control system becomes very unstable when $T_f'-T_f<0$. Therefore, it is practical to establish the relation $T_f'-T_f>0$ so that the difference between $T_f'$ and $T_f$ acts effectively as a frictional force.

Thus, when the relation $(T_f'-T_f)$ is selected to be positive, the error $(\theta_t-\theta)$ is now expressed as follows:

$$\theta_t - \theta = \pm\left\{ \frac{1}{I_s (a^2 + b^2)} (T_f' - T_f) \right\}$$

Figure 8:
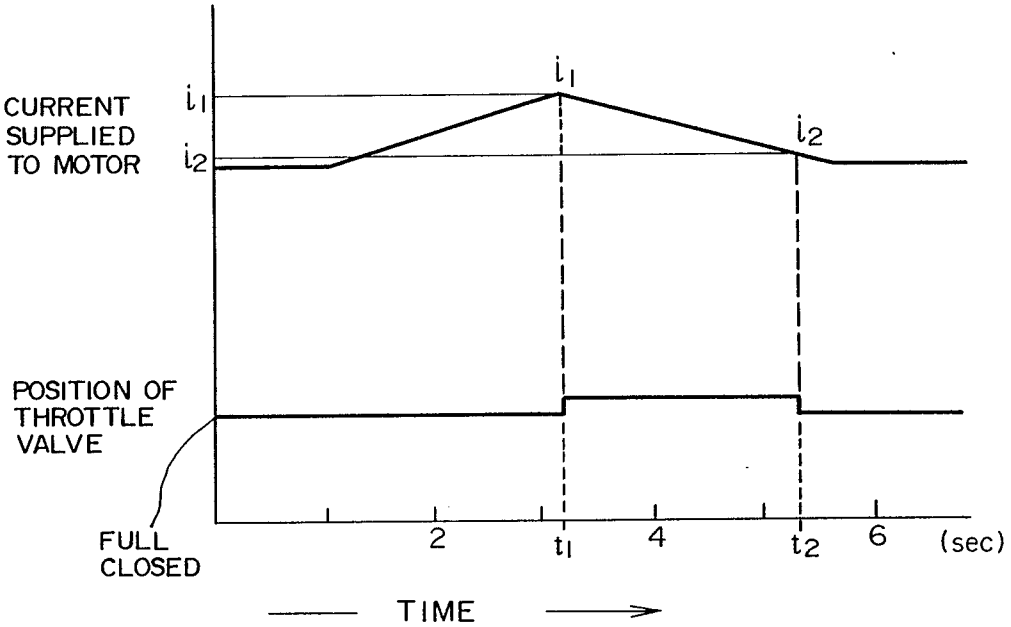
FIG. 8 is a graph showing very slight movement of the throttle valve when the current supplied to the motor is gradually increased and then decreased.

FIG. 8 is a graph showing very slight movement of the throttle valve 8 when the current supplied to the D.C. motor 3 is gradually increased and then decreased. In this case, no position control is effected, and the current supplied to the D.C. motor 3 is merely primarily considered and changed. FIG. 8 shows that, with the increase in the current supplied to the D.C. motor 3, the throttle valve 8 starts to move at time $t_1$ corresponding to a current value $i_1$, and, with the subsequent decrease in the current, the throttle valve 8 starts to move again at time $t_2$ corresponding to a current value $i_2$. Under the above situation, the following equations are obtained:

$$K_m i_1 = K_s\theta_o' + T_f'$$

$$K_m i_2 = K_s\theta_o' - T_f'$$

Therefore, from the above equations, the value of $\theta_o'$ can be studied (estimated) as follows:

$$\theta_o' = \frac{K_m}{K_s} (i_1 + i_2)$$

Thus, when the value of the parameter $\theta_o$ is selected to satisfy the relation $$\theta_o = \frac{K_m}{K_s}(i_1 + i_2)$$

The wave of $\theta_o'$ can be estimated from the value of $\theta_o$, and the required compensation can be made. (This means that the parameter $\theta_o$ can be updated.)

Figure 9:
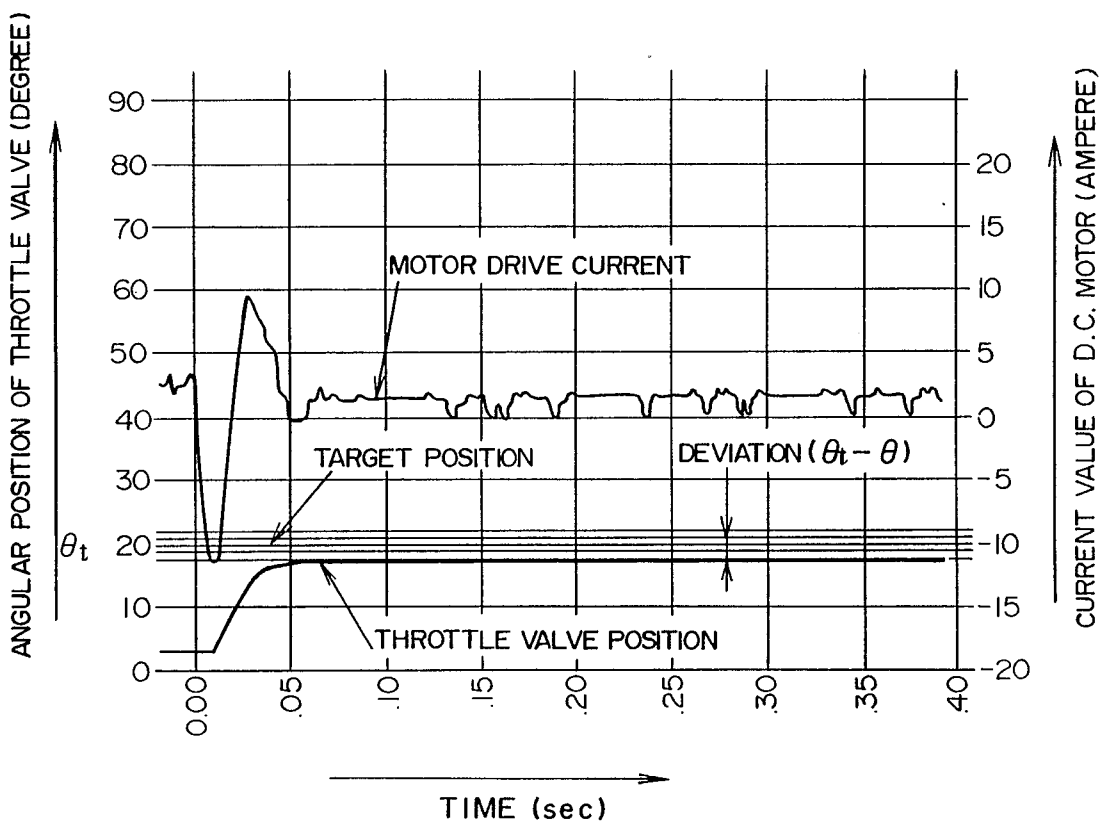
FIG. 9 is a graph similar to FIG. 4 to show the control characteristics of the embodiment shown in FIG. 7.

FIG. 9 is a graph showing an example of the response characteristics of the embodiment shown in FIG. 7 when the relation between the parameters $T_f'$ and $T_f$ is given by $T_f' - T_f > 0$.

In the graph shown in FIG. 9, the target angular position $\theta_t$ of the throttle valve 8 is $\theta_t = 20°$. Because of the relation $T_f' - T_f > 0$, an error $(\theta_t - \theta)$ as indicated by the arrows remain without being compensated.

This error can be cancelled by establishing the relation $T_f' - T_f = 0$. However, strict attainment of this relation $T_f' - T_f = 0$ is difficult as a matter of fact. Therefore, when the values of the parameters a and b are suitably changed to cause a slight overshoot in the response of the throttle valve 8, and the difference $(T_f' - T_f)$ is compensated by this overshoot, highly accurate and stable control characteristics like those shown in FIG. 4 can be exhibited.

Figure 10:
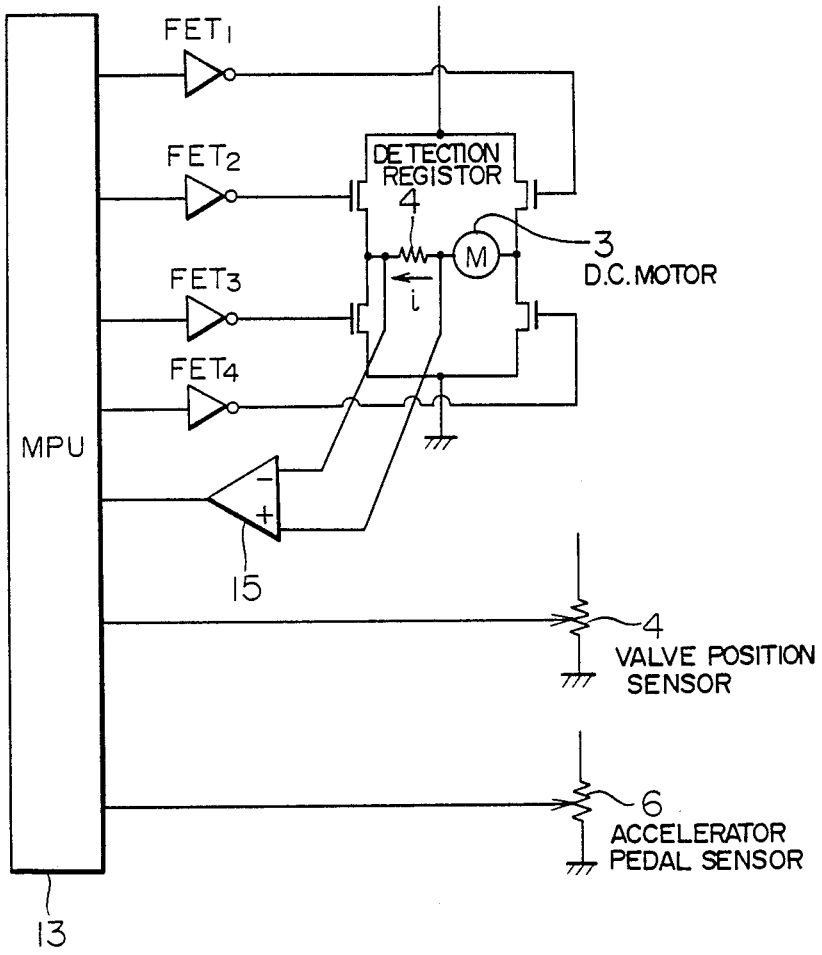
FIG. 10 is a circuit diagram showing the practical structure of the control circuit 5 shown in FIG. 2.

FIG. 10 shows the internal structure of the control circuit 5 shown in FIG. 2.

Referring to FIG. 10, a one-chip microprocessor (MPU) 13 is an essential part of the control circuit 5 and has a program-storing ROM, a RAM and an A/D converter built therein. The output signal of the accelerator pedal sensor 6 and that of the throttle valve position sensor 4 are A/D converted by the A/D converter (not shown) to selectively drive four field-effect transistors $FET_1$ to $FET_4$ thereby controlling the current supplied to the D.C. motor 3. Further, the value of the motor current of the D.C. motor 3 is detected in the form of a voltage appearing across a detection resistor 14, and, after being amplified by an amplifier 15, the detected voltage is applied to the MPU 13 so as to continuously control the value of the motor current.

Figure 11:
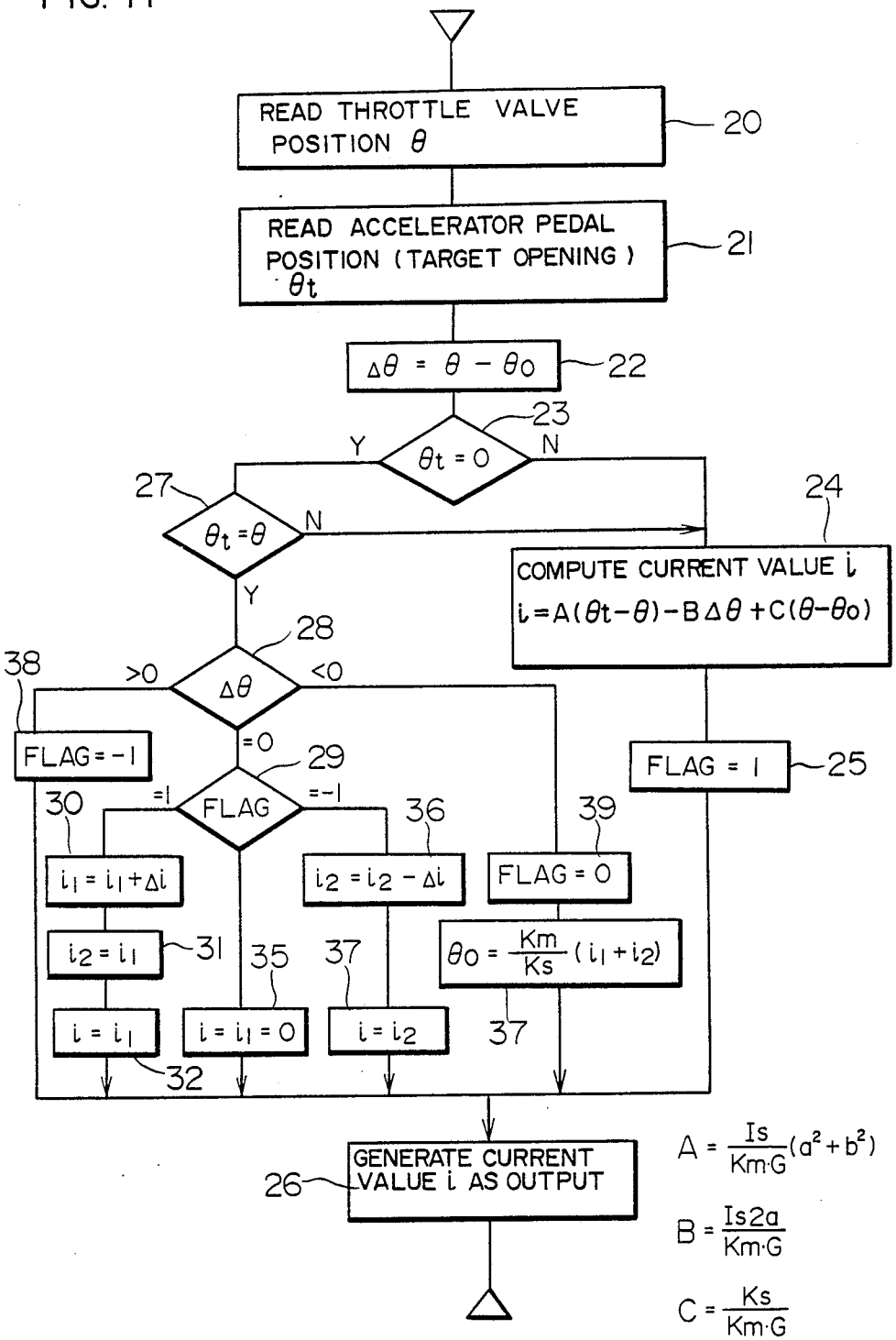
FIG. 11 is a flow chart for illustrating the control method according to the present invention.

FIG. 11 is a flow chart of a sequence of arithmetic and logical processing and decision steps executed according to a control program stored in the MPU 13. The flow shown in FIG. 11 is run at an interval of a predetermined period of time under control of a time scheduler.

In a step 20 in FIG. 11, the actual angular position $\theta$ of the throttle valve 8 is read, and, in a step 21, the position $\theta_t$ of the accelerator pedal (the target value of the opening of the throttle valve 8) is read. In a step 22, the very small change $\Delta\theta = \theta - \theta_o$ is computed.

Then, in a step 23, decision is made as to whether or not the target value $\theta_t$ is $\theta_t = 0$. When the result of decision in the step 23 is "No", the step 23 is followed by a step 24. Also, when the result of decision made in a step 27 as to whether or not the target value $\theta_t$ is approximately equal to the value of the actual position $\theta$ of the throttle valve 8 is "No", the step 27 is followed by the step 24. In the step 24, the value of the motor current i is computed according to an equation $$i = A(\theta_t - \theta) - B\Delta\theta + C(\theta - \theta_o), \text{ where}$$

$$A = \frac{I_s(a^2 + b^2)}{K_m \cdot G}, \; B = \frac{I_s\, 2_a}{K_m \cdot G} \text{ and } C = \frac{K_s}{K_m \cdot G}.$$

Then, in a step 25, a flag = 1 is set, and, in a step 26, the computed current value i is generated as the output.

On the other hand, when the result of decision made in the step 23 proves that the target value $\theta_t$ is $\theta_t = 0$, and the result of decision made in the step 27 proves that the value of the actual position $\theta$ is also approximately equal to the target value $\theta_t$ $(\theta_t \approx \theta)$, decision is made in a step 28 as to whether or not the very small change $\Delta\theta$ is zero $(\Delta\theta = 0)$. When the result of decision in the step 28 is "Yes" $(\Delta\theta = 0)$, the flag is referenced in a step 29. When the flag = 1, the step 29 is followed by a step 30 in which $i_1 = i_1 + \Delta i$ is computed. Then, in a step 31, $i_2 = i_1$ is computed, and, in a step 32, $i = i_1$ is computed to determine the current value i. On the other hand, when the result of decision in the step 29 proves that the flag = −1, $i_2 = i_2 - \Delta i$ is computed in a step 32, and the current value $i = i_2$ is determined in a step 37. Also, when the result of decision in the step 29 proves that the flag = 0, $i = i_1 = 0$ is determined in a step 35. That is, when the result of decision in step 29 proves that the flag = 0, the MPU 13 decides that the process of study has been completed and initializes the current values i and $i_1$.

On the other hand, when the result of decision in the step 28 proves that $\Delta\theta < 0$, the step 28 is followed by a step 39 in which the flag is cleared, and the studied value of $\theta_o$ is determined in a step 40. As described already, $\theta_o$ is given by $$\theta_o = \frac{K_m}{K_s}(i_1 + i_2).$$

This studied value of $\theta_o$ is used in the later control.

According to the aforementioned embodiments of the present invention, the current/torque constant of the D.C. motor in the steady state can be studied so that a steady-state error can be easily cancelled. Therefore, the control system can automatically adapt itself to changes in the environmental conditions and secular variations in the state mounted on the vehicle, so that the throttle valve can be highly accurately positioned without sacrificing the high-speed response capability.

The throttle valve control method according to the present invention provides the following practical advantages:

(i) The use of the D.C. motor in the throttle valve drive mechanism improves the high-speed response capability of the throttle valve.

(ii) The throttle valve can be controlled with high accuracy without being adversely affected by changes in its operating conditions as well as secular variations.

(iii) Simple arithmetic equations are merely required for the purpose of controlling the throttle valve. Therefore, a relatively inexpensive small-capacity microprocessor can be sufficiently satisfactorily used for the purpose of computation.

Also, according to the throttle valve control apparatus of the present invention, the control method described above can be easily and effectively practised so as to fully exhibit the advantages enumerated above.

We claim:

1. A method of controlling a throttle valve in an internal combustion engine provided with a throttle valve drive mechanism including said throttle valve disposed in a venturi in said engine, an electric motor coupled to the shaft of said throttle valve, an angular position of rotation sensor mounted on the shaft of said throttle valve, and a return spring normally biasing said throttle valve in a direction in which said throttle valve is returned toward a predetermined angular position, said return spring being imparted with an initial load, said throttle valve drive mechanism being controlled by a control circuit receiving the output signal of said sensor as an input, said method comprising the steps of:

(a) using inertial mass of means driving said throttle valve, a current/torque constant of said motor and a dimensionless parameter to express a gain applied to an error between a target angular position and an actual angular position of said throttle valve;

(b) using the inertial mass of said throttle valve driving means, the current/torque constant of said motor and a dimensionless parameter to express a gain applied to a differentiated value of the actual angular position of said throttle valve; and (c) using a spring constant of said return spring to express a gain applied to the actual angular position of said throttle valve.

2. A method of controlling a throttle valve in an internal combustion engine according to claim 1, wherein the ratio between said dimensionless parameter used in said step (a) and said dimensionless parameter used in said step (b) is set at a predetermined value.

3. A method of controlling a throttle valve in an internal combustion engine according to claim 1, wherein, in the computation of said dimensionless parameters, the value of at least one of said spring constant, frictional torque of the shaft of said throttle valve and frictional torque of the rotor shaft of said motor is set to be smaller than an actually measured value.

4. A method of controlling a throttle valve in an internal combustion engine according to claim 2, wherein, in the computation of said dimensionless parameters, the value of at least one of said spring constant, frictional torque of the shaft of said throttle valve and frictional torque of the rotor shaft of said motor is set to be smaller than an actually measured value.

5. A method of controlling a throttle valve in an internal combustion engine according to claim 1, wherein, in the computation of said dimensionless parameters, the value of at least one of said spring constant, frictional torque of the shaft of said throttle valve and frictional torque of the rotor shaft of said motor is set to be smaller than a designed value.

6. An apparatus for controlling a throttle valve in an internal combustion engine provided with a throttle valve drive mechanism including said throttle valve disposed in a venturi in said engine, an electric motor coupled to the shaft of said throttle valve, an angular position of rotation sensor mounted on the shaft of said throttle valve, and a return spring normally biasing said throttle valve in a direction in which said throttle valve is returned toward a predetermined angular position, said return spring being imparted with an initial load, said apparatus comprising a control circuit receiving the output signal of said sensor as an input for controlling said throttle valve drive mechanism, wherein:

(a') said control circuit includes means for storing the value of motor current at the moment said throttle valve starts to move from the predetermined angular position; and (b') said control circuit also includes means for computing the initial load of said return spring on the basis of said motor current value.

* * * * *